US011186416B2

(12) United States Patent
Sunning et al.

(10) Patent No.: US 11,186,416 B2
(45) Date of Patent: Nov. 30, 2021

(54) PUSH-AND-PULL SEALING DISC FOR PACKAGING CONTAINER

(71) Applicant: AR Packaging Systems AB, Lund (SE)

(72) Inventors: Eva Sunning, Annelöv (SE); Berth-Ola Göthe, Kopingebro (SE); Fredrik Konstenius, Lund (SE); Simon Holka, Staffanstorp (SE)

(73) Assignee: AR Packaging Systems AB

( * ) Notice: Subject to any disclaimer, the term of this patent is extended or adjusted under 35 U.S.C. 154(b) by 243 days.

(21) Appl. No.: 16/315,903

(22) PCT Filed: Jul. 6, 2017

(86) PCT No.: PCT/SE2017/050761
§ 371 (c)(1),
(2) Date: Jan. 7, 2019

(87) PCT Pub. No.: WO2018/009136
PCT Pub. Date: Jan. 11, 2018

(65) Prior Publication Data

US 2019/0135508 A1 May 9, 2019

(30) Foreign Application Priority Data

Jul. 6, 2016 (SE) ..... 1650990-3

(51) Int. Cl.
*B65D 51/20* (2006.01)
*B65D 77/20* (2006.01)
(Continued)

(52) U.S. Cl.
CPC ..... *B65D 51/20* (2013.01); *B65D 3/268* (2013.01); *B65D 17/401* (2018.01);
(Continued)

(58) Field of Classification Search
CPC ... B65D 1/20; B65D 3/20; B65D 1/22; B65D 3/263; B65D 3/00; B65D 1/06;
(Continued)

(56) References Cited

U.S. PATENT DOCUMENTS 3,019,944 A 2/1962 Nelson
3,411,692 A * 11/1968 Mathews ..... B65D 5/3614 229/106

(Continued)

FOREIGN PATENT DOCUMENTS

GB 274556 A 7/1927
GB 998102 A 7/1965
WO 2014084732 A1 6/2014

OTHER PUBLICATIONS

International Search Report for Application No. PCT/SE2017/050761 dated Sep. 5, 2017, 5 pages.

(Continued)

*Primary Examiner* — Steven A. Reynolds
*Assistant Examiner* — Javier A Pagan
(74) *Attorney, Agent, or Firm* — Lerner, David, Littenberg, Krumholz & Mentlik, LLP

(57) ABSTRACT

The present disclosure relates to a paperboard sealing disc for use in a packaging container, comprising a peripheral edge portion surrounding a tear-open part having a push-tab and a pull-away part. The tear-open part is delimited from the peripheral edge portion by a first cutting line in the first side and by a second cutting line in the second side. Said first cutting line being provided at a distance d1 from said sealing disc outer edge, and said second cutting line being provided at a distance d2 from said sealing disc outer edge. The push-tab is at least partly delimited from the pull-away part by a folding line. At the push-tab d1>d2 and at the pull-away part d4>d3. Furthermore, d1 at said push-tab is substantially (Continued)

the same as d4 at said pull-away part and d2 at said push-tab is substantially the same as d3 at said pull-away part.

16 Claims, 5 Drawing Sheets

(51) Int. Cl.
*B65D 17/28* (2006.01)
*B65D 3/26* (2006.01)
*B65D 43/16* (2006.01)

(52) U.S. Cl.
CPC ..... *B65D 43/162* (2013.01); *B65D 77/20* (2013.01); *B65D 2251/009* (2013.01); *B65D 2251/0021* (2013.01)

(58) Field of Classification Search
CPC ... B65D 5/54; B65D 5/70; B65D 5/74; B65D 5/741; B65D 5/742; B65D 5/743; B65D 5/744; B65D 5/708; B65D 3/12; B65D 5/706; B65D 5/4802; B65D 3/264; B65D 3/267; B65D 5/4229; B65D 5/703; B65D 5/705; B65D 17/16; B65D 51/585; B65D 51/20; B65D 51/75; B65D 51/5833; B65D 51/5838; B65D 77/2048; B65D 77/2052; B65D 77/2056; B65D 2577/205; B65D 2577/2091
USPC ..... 220/265, 266, 258.5, 276, 359.2, 258.2, 220/258.3; 229/200, 207, 123.1, 245
See application file for complete search history.

(56) References Cited

U.S. PATENT DOCUMENTS

| | | | | |
|---|---|---|---|---|
| 3,776,450 | A | 12/1973 | Christensson | |
| 3,982,685 | A * | 9/1976 | Shimada | B65D 5/54 229/51 |
| 4,556,152 | A | 12/1985 | Bogren | |
| 2007/0145055 | A1* | 6/2007 | Gardiner | B65D 17/4014 220/254.4 |
| 2015/0041470 | A1 | 2/2015 | Huffer et al. | |
| 2015/0041471 | A1* | 2/2015 | Huffer | B65D 17/163 220/270 |
| 2016/0096667 | A1 | 4/2016 | Huffer | |

OTHER PUBLICATIONS

Swedish Search Report for Application No. 1650990-3 dated Feb. 24, 2017, 3 pages.
Supplementary European Search Report including Written Opinion for Application No. EP17824638.5, dated Feb. 19, 2020, pp. 1-7.

* cited by examiner

PUSH-AND-PULL SEALING DISC FOR PACKAGING CONTAINER

CROSS-REFERENCE TO RELATED APPLICATIONS

The present application is a national phase entry under 35 U.S.C § 371 of International Application No. PCT/SE2017/050761, filed Jul. 6, 2017, which claims priority from Swedish Application No. 1650990-3, filed Jul. 6, 2016, all of which are hereby incorporated herein by reference.

TECHNICAL FIELD

The present disclosure pertains to a sealing disc for use in a packaging container for bulk solids. More specifically, the present disclosure pertains to a sealing disc having improved opening characteristics. The present disclosure also pertains to a packaging container comprising the sealing disc.

BACKGROUND OF THE INVENTION

When packaging consumer goods, and in particular when packaging bulk solids, such as dry flowable consumer goods, it is common to use rigid paperboard packaging containers which serve as protective transport and storage containers at the retail end and as storage and dispensing containers at the consumer end. Such paperboard containers are usually provided with an openable and closable lid, and with an inner removable or breakable transport closure which keeps the contents fresh and protected against contamination up until the container is opened by a consumer.

It is known to provide the packages with means to facilitate for the consumer to gain access to the product. For this purpose, packaging container lids may be provided with tear-open parts which are opened by push-tabs and/or pull-tabs. However, when pushing or pulling such tabs, and especially for paperboard container lids, there is a risk of tearing of the tear-open part, or tearing of the push-tabs or pull-tabs. The openability of a container lid or a transport closure is thus affected by the depth and the length of the cuts. However, on the other side, the more perforated the material is, the weaker the package will become and the risk of leakage increases. For such sealing discs it has been found that there exists a need to improve the openability with preserved integrity of the container prior to opening of the sealing disc.

SUMMARY OF THE INVENTION

An object of the present disclosure is to provide a sealing disc for use in a packaging container providing facilitated opening and an improved protection prior to opening of the sealing disc.

As such and according to a first aspect, the present disclosure relates to a paperboard sealing disc for use in a packaging container. The sealing disc is delimited by a sealing outer edge. The sealing disc comprises a peripheral edge portion surrounding a tear-open part. The sealing disc also comprises a first side and a second side. The tear-open part is delimited from the peripheral edge portion by a first cutting line provided on the first side and by a second cutting line provided on the second side. The tear-open part furthermore comprises a push-tab and a pull-away part, the push-tab being at least partly delimited with respect to the pull-away part by a folding line. The first and the second cutting lines provided at the first and the second side, respectively, extend only partially through the thickness of the sealing disc. The first cutting line is, at the push-tab, provided at a distance d1 from the sealing disc outer edge the second cutting line is, at the push-tab, provided at a distance d2 from the sealing disc outer edge. The first cutting line is, at the pull-away part, provided at a distance d3 from the sealing disc outer edge and the second cutting line is, at the pull-away part, provided at a distance d4 from the sealing disc outer edge. The first cutting line is intersecting with the second cutting line at a first and a second intersection. At the push-tab d1>d2, and at the pull-away part d4>d3. Furthermore, d1 at the push-tab is substantially the same as d4 at the pull-away part and d2 at the push-tab is substantially the same as d3 at the pull-away part.

The first cutting line and the second cutting line are made from opposing sides of the sealing disc, i.e. from opposite outer surfaces of the sealing disc. The first cutting line has a first depth and the second cutting line has a second depth. The cutting line should not extend throughout the entire thickness and may extend through from 15 to 80% of the sealing disc thickness. It may be preferred that the sum of the depths of the first and second cutting lines is equal or substantially equal to a thickness of the sealing disc. As the first and second cutting lines are off-set from each other in the plane of the sealing disc, they do not meet in the interior of the sealing disc.

As the paperboard sealing disc is provided with first and second cutting lines which each do not extend throughout the entire thickness of the sealing disc, the paperboard will delaminate at, or around, the push-tab when exerting pressure thereto and pushing it downwards into the packaging container, and also around the tear-open part when pulling it upwards after opening the sealing disc by means of the push-tab.

The first and second cutting lines are both arranged in the same paperboard base material and tearing open of the sealing disc takes place by separation of the fibres in a first part of the material from the fibres in a second part of the material. Accordingly, separation takes place within the paperboard base material and in the plane of the sealing disc, dividing the sealing disc into a first and a second part.

A sealing disc made of paperboard may at the level where the cutting line extends, delaminate even if there are not initially two material layers provided. The paperboard material then delaminates due to the nature of paperboard.

As such and according to a second aspect, the present disclosure also relates to a paperboard sealing disc for use in a packaging container. The sealing disc is delimited by a sealing disc outer edge. The sealing disc comprises a peripheral edge portion surrounding a tear-open part. The sealing disc also comprises a first layer and a second layer. The tear-open part is delimited from the peripheral edge portion by a first cutting line through the first layer and by a second cutting line through the second layer. The tear-open part furthermore comprises a push-tab and a pull-away part, the push-tab being at least partly delimited with respect to the pull-away part by a folding line. The first cutting line is, at the push-tab, provided at a distance d1 from the sealing disc outer edge, and the second cutting line is, at the push-tab, provided at a distance d2 from the sealing disc outer edge. The first cutting line is, at the pull-away part, provided at a distance d3 from the sealing disc outer edge, and the second cutting line is, at the pull-away part, provided at a distance d4 from the sealing disc outer edge. The first cutting line intersects with the second cutting line at a first and a second intersection. At the push-tab d1>d2, and at the pull-away part d4>d3. Furthermore, d1 at the push-tab is substantially the same as d4 at the pull-away part and d2 at the push-tab is substantially the same as d3 at the pull-away part.

As set out herein and according to the first aspect, the sealing disc may comprise a single uniform planar base material, such as a paperboard material. As used herein, a paperboard material is a sheet material predominantly made from cellulose fibers or paper fibers. The paperboard material may be a single ply or multi ply material and may be coated, printed, embossed, etc. and may comprise fillers, pigments, binders and other additives as known in the art. The paperboard material may be a laminate comprising one or more layers of materials such as polymeric films and coatings, metal foil, etc. The polymeric films and coatings may include or consist of thermoplastic polymers. The paperboard materials as disclosed herein may also be referred to as cardboard or carton materials.

Alternatively and according to the second aspect, the sealing disc may be made from two layers of base material which have been joined, e.g. by welding or adhesively and which can be separated at the interface between the layers. The first layer may e.g. be laminated to the second layer. The two layers of base material may be made from any useful sheet material, such as paperboard, paper, nonwoven, aluminum foil, plastic and may be the same or different. The sealing disc comprising two layers may also be a paperboard sealing disc comprising either one paperboard layer, single or multi ply, and one further layer, which could be the same type of layer or a different type.

When the sealing disc is used to seal an inner compartment of a packaging container, the first part constitutes an outer part of the sealing disc which faces away from the inner compartment and the second part constitutes an inner part of the sealing disc which faces towards the inner compartment.

The first cutting line and the second cutting line are made from opposing sides of the sealing disc, i.e. from opposite outer surfaces of the sealing disc.

By "cutting line" is meant a continuous or discontinuous cutting line provided around the tear-open part, allowing rupture of the sealing disc between the tear-open part and the peripheral edge portion at a predefined location.

When the sealing disc, according to the second aspect, comprises a first and a second layer and the first and second cutting line is provided in the first and second layer respectively, i.e. the first cutting line extends through the first layer and not the second layer and the second cutting line extends through the second layer and not the first layer, the first and second layer will delaminate, similarly as the paperboard, at the cutting line.

The fact that the cutting lines are not provided throughout the entire sealing disc thickness improves the integrity of the sealing disc and thus the sealing properties of the packaging container when sealed with the sealing disc. The risk of air and bacteria entering the packaging container is reduced and the shelf life of the contents is prolonged.

The tear-open part of the sealing disc is adapted to be released by means of the push-tab being pressed downwards and into the packaging container. The push-tab is folded inwards along the folding line and under the pull-away part. As the distance d2 is greater than the distance d1 at the push-tab, i.e. where the push-tab is delimited from the peripheral edge portion, the second cutting line is provided closer to the outer edge of the sealing disc than the first cutting line, the pressure required to press the push-tab to an open position is reduced.

The first cutting line is intersecting with said second cutting line at a first and a second intersection. Optionally the first and second cutting lines at the first and second sides are spaced apart from each other such that a notch having an angle $\alpha$ of between 75° and 115°, such as between 85° and 95°, is formed on the tear-open part by the first and second cutting lines at each of said first and second intersections between the push-tab part and the pull-away part when the push-tab has been folded downwards. The first and second cutting lines at the first and second sides may be spaced apart from each other such that a notch having the angle $\alpha$ may be essentially 90° is formed when the push-tab has been folded downwards.

The two notches are formed where the transition in widths from d1 to d2, and d4 to d3 for the first and second cutting lines on the tear-open part are located. A first notch is formed at the first intersection where the transition in width from d1 to d2 on the first side/layer, and the transition from d4 to d3 on the second side/layer are located. A second notch is formed at the second intersection where the transition in width from d4 to d3 on the first side/layer, and transition from d1 to d2 on the second side/layer is located. The formed notches further facilitate the folding of the push-tab in a downward direction and the upward pulling of the pull-away part.

After release of the push-tab the inner layer forms a collar at the push-tab. As the push-tab is adapted to be folded inwards at the folding line and under the pull-away part an opening and a gripping portion may be provided, such that the pull-away part may be gripped and fully or partly removed from the sealing disc. The removal of the pull-away part upwards is facilitated as the distance d3 is greater than the distance d4 at the pull-away part forming a collar on the outer material of the pull-away part. The fact that d1 at the push-tab is substantially the same as d4 at the pull-away part and d2 at the push-tab is substantially the same as d3 at the pull-away part leads to a facilitated opening of the pull-away part. This is due to that the peripheral border of the second side/second layer remaining after removal of the tear-open part will be continuous with the remaining peripheral border of the first side/first layer, thus forming a continuous regular inner edge. This renders the sealing disc solution according to this disclosure particularly suitable for use in packaging containers for scoopable bulk solids, as the inner edge is resistant to wearing resulting from repeated scooping or pouring from the packaging container.

Furthermore, as the inner edge of the peripheral border is unbroken and there is no protruding parts formed upon opening, the pull-away part is easy to open and there will be no interfering when folding back the push-tab and pulling away the pull-away part.

To facilitate the folding of the push-tab inwards and under the pull-away part, the first side or the first layer of the sealing disc is provided with a folding line on the first side or first layer of the sealing disc. The folding line may extend as a straight line from the first intersection between the first and second cutting line to the second intersection between the first and second cutting line on the tear-open part of the sealing disc. The first side/first layer thus being on the side intended to face away from the inner compartment of the packaging container. Optionally said folding line is a slit formed by a portion of the first cutting line which extends between the first and second intersections formed between the first and second cutting lines.

The folding line delimits at least partly the push-tab from the pull-away part such that it is only the push-tab that is folded downwards during the folding action, while the pull-away part remains substantially unaffected by the downward pushing action. A slit provided in the first layer renders the downwards folding easy and precise and the pull-away part of the sealing disc remains connected to the peripheral edge of the sealing disc when the push-tab is folded downwards.

Optionally, the difference between d1 and d2 and between d3 and 4 are each within the range of from 2 mm to 10 mm.

A difference between d1 and d2, and d3 and d4, are each within the range of from 2 mm to 10 mm provide increased sealing properties and also minimizes the risk for tearing of the tear-open part or the peripheral border during opening of the sealing disc. If the difference is too small there is a risk that the effect of having one cutting line at each side of the sealing disc is lost as no collars will form on the inner layer/side during the folding of the push-tab or on the outer layer during the removal of the pull-away part. The remaining peripheral edge of the sealing disc will be frayed and discontinuous. If the difference is too large there is a risk that the base material (paperboard) or two layers won't separate properly into two parts or two layers which may result in the tearing of the tear-open part and/or the remaining peripheral edge of the sealing disc.

Optionally, the distance d1 is within the range of from 5 mm to 35 mm. Optionally, the distance d1 is within the range of from 5 mm to 20 mm.

Optionally, the distance d2 is within the range of from 5 mm to 35 mm. Optionally, the distance d2 is within the range of from 5 mm to 20 mm.

Optionally, the distance d3 is within the range of from 5 mm to 35 mm. Optionally, the distance d3 is within the range of from 5 mm to 20 mm.

Optionally, the distance d4 is within the range of from 5 mm to 35 mm. Optionally, the distance d4 is within the range of from 5 mm to 20 mm.

Optionally, the sealing disc and the tear-open part each have a rectangular shape or a modified rectangular shape. The sealing disc normally has the same shape as the contour of the inner walls of the container it is supposed to seal, and the tear-open part may have the same contour as the sealing disc or a modified rectangular shape. With modified rectangular shape as used herein is meant a rectangle with slightly rounded corners. Rounded corners enhance the removal of the tear-open part diminishes the risk of fraying the peripheral edge of the remaining sealing disc Optionally, the push-tab is provided in a corner portion of the tear-open part. The push-tab being provided in a corner portion facilitates the opening of the push-tab as the cutting line surrounding the push-tab is increased. Also folding downwards of the push-tab is made easier in such an arrangement as a straight folding line may be provided.

The push-tab may for example be provided in a corner position of a rectangular or modified rectangular tear-open part. Advantageously the tear-open part is further provided with a folding line on the first side/layer of the sealing disc to facilitate the folding of the push-tab. The folding line may extend as a straight line, from a first intersection between the first and second cutting lines to the second intersection between the first and second cutting lines. A folding line provided at the first side or in the first layer facilitates downwards folding of the push-tab when it is positioned in the corner of a rectangular or modified rectangular tear-open part.

To further facilitate the folding of a push-tab part arranged in a corner position of a rectangular or modified rectangular tear-open part, the folding line may be a slit. The slit may be formed by a portion of said first cutting line extending between said first and second intersections between said first and second cutting lines. A slit provided in the first layer renders the downwards folding easy and precise. The fact that the push-tab part arranged in a corner position with a facilitated folding of the push-tab renders the sealing disc particularly suitable for bulk solids which may be poured from the packaging container.

According to a third aspect, the present disclosure relates to a packaging container for bulk solids. The container comprises a tubular container body with an upper end with an upper body opening and a bottom end with a bottom body opening comprising a container bottom. The container body has an inner surface facing towards an inner compartment in the packaging container and an outer surface facing away from the inner compartment. The packaging container is closed at the upper body opening by a sealing disc according to the first aspect of the present disclosure.

Optionally, the packaging container is a paperboard packaging container.

It may be preferred that the sealing disc and the packaging container as disclosed herein have a modified rectangular shape with four side edges joined by four curved corner portions. Modified rectangular shapes include modified square shapes, i.e. rectangular shapes having side edges of equal length. The side edges may be straight side edges or may have a slight curvature, with a radius of curvature in the range of from 200-700 mm, preferably 300-600 mm, more preferably 400-500 mm.

The side edges of a sealing disc or packaging container having rectangular or modified rectangular shape may consist of first and second longitudinal side edges and first and second transverse side edges, the longitudinal side edges having a length greater than a length of the transverse side edges.

The radius of curvature of the curved corner portions may be in the range of 5-60 mm, preferably 10-40 mm, more preferably 15-30 mm.

Optionally, the sealing disc is a container lid, being the only lid provided on the container.

Optionally, the container comprises a container lid and the sealing disc is provided in addition to the container lid as a transport closure.

As used herein, a paperboard packaging container is a packaging container wherein the container body is formed from paperboard web material. An all paperboard packaging container, as disclosed herein, is a paperboard container which is entirely made from paperboard material and which, specifically does not include components such as a plastic rim or other plastic parts. The paperboard container may be formed in any manner known in the art, e.g. by forming a container body by bending a paperboard web material into a tubular shape and longitudinally closing the tube by joining overlapping or abutting side edges of the paperboard material. The join between the side edges may be covered by a sealing strip. Preferably, the paperboard packaging container is formed by the method as disclosed herein. The container bottom may be formed from a separate bottom disc which is attached at one end of the container body tube or may be formed by folding an end portion of the container body tube.

As used herein, the term "bulk solids" refers to a solid material. The bulk material may be dry or moist. The bulk solids may be in the form of particles, granules, grinds, plant fragments, short fibres, flakes, seeds, formed pieces of material such as pasta, etc. The bulk solids which are suitable for packaging in the packaging containers as disclosed herein may be flowable, which means that a desired amount of the product may be poured or scooped out of the packaging container, or in the form of discreet pieces of material allowing removal of only part of the content in the packaging container.

The packaging container as disclosed herein may be a container for alimentary products such as infant formula, coffee, tea, rice, pasta, flour, sugar, cereals, soup powder, custard powder, or the like. Alternatively, the bulk solids may be non-alimentary, such as tobacco, detergent, fertilizer, chemicals or the like.

DETAILED DESCRIPTION

It is to be understood that the drawings are schematic and that individual components, such as layers of materials are not necessarily drawn to scale. The sealing discs and the packaging containers shown in the figures are provided as examples only and should not be considered limiting to the invention. Accordingly, the scope of invention is determined solely by the scope of the appended claims.

Figure 1:
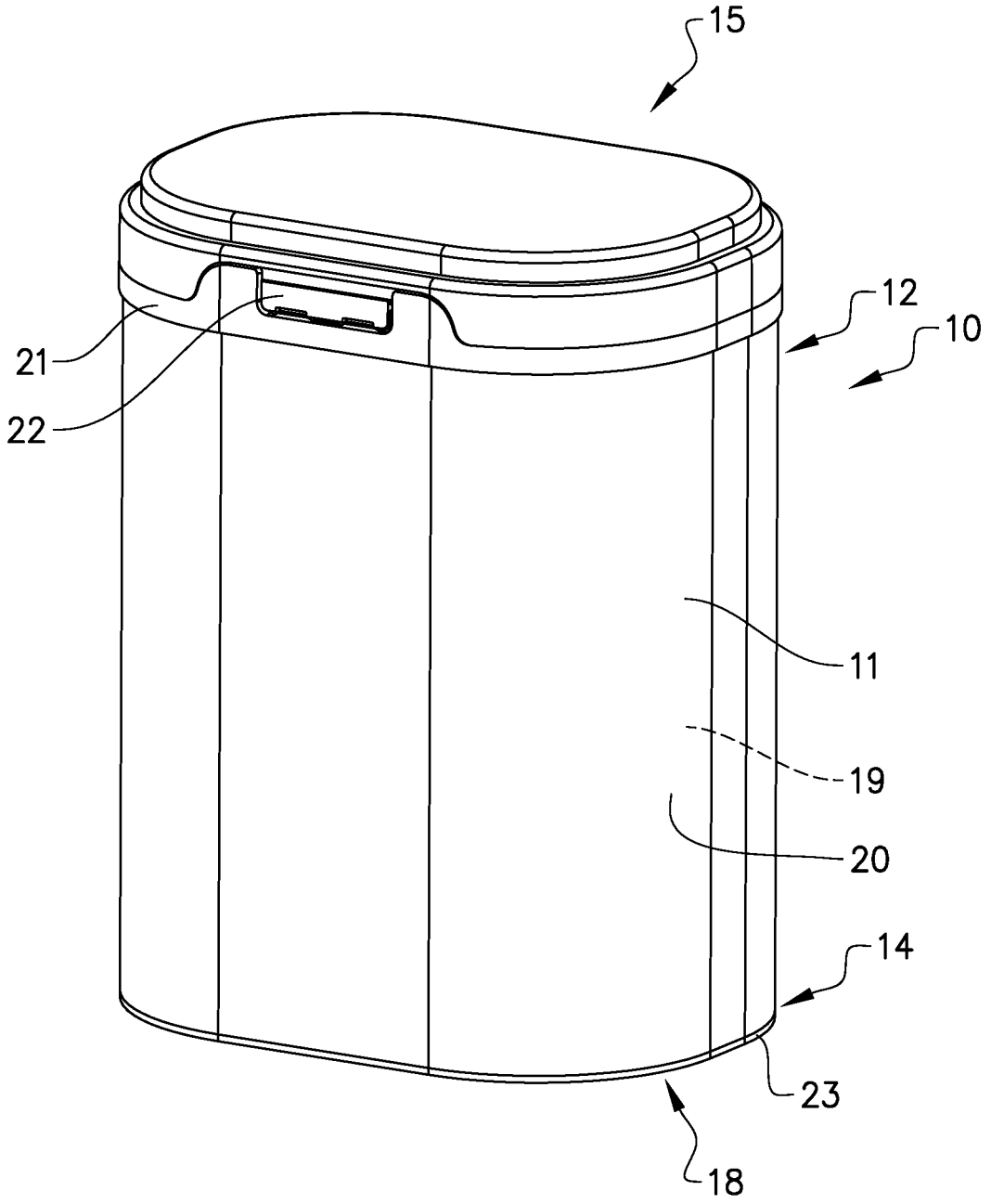
FIG. 1 illustrates a packaging container according to the present disclosure.
Figure 2:
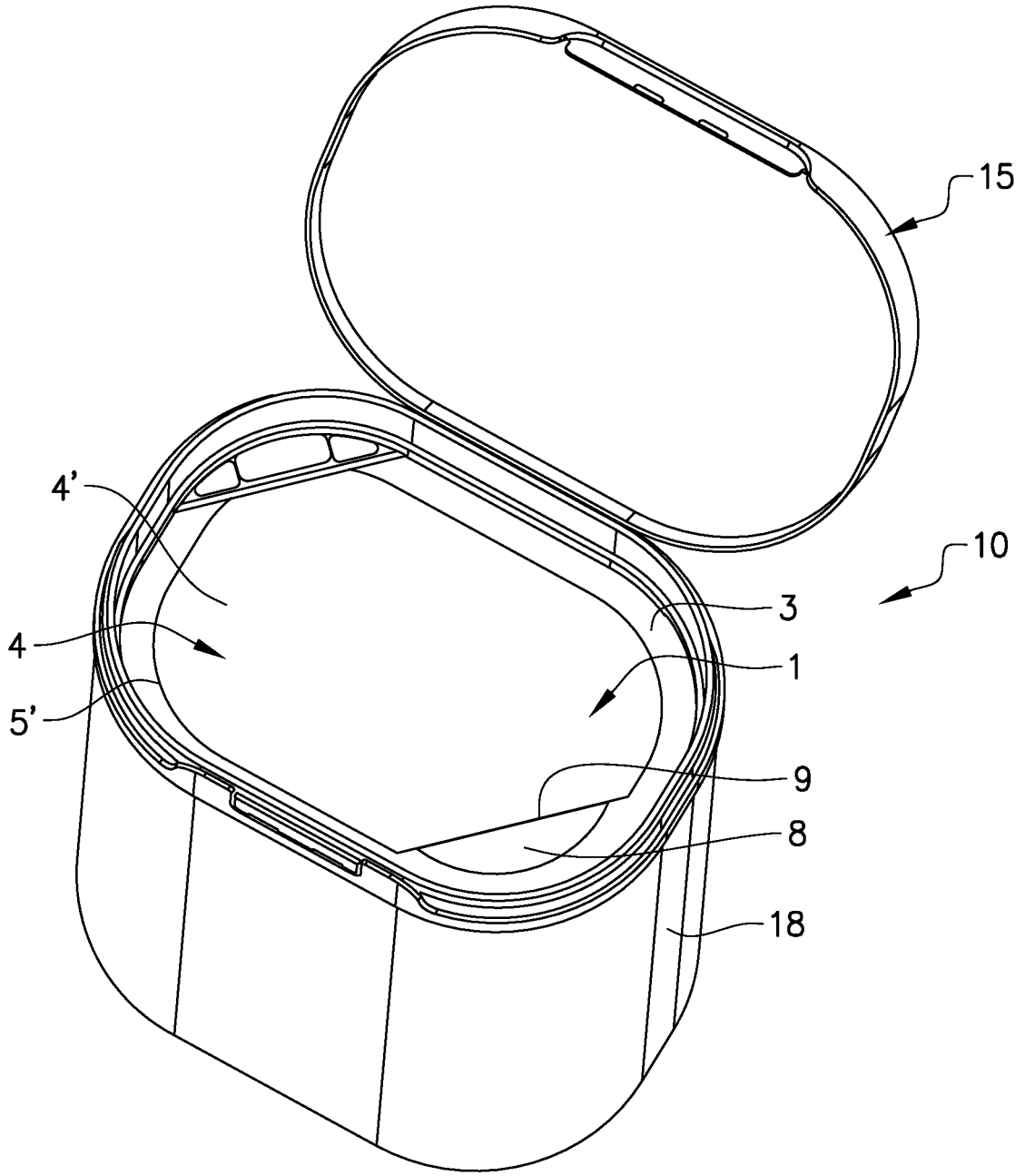
FIG. 2 illustrates a packaging container in an open position comprising a sealing disc according to the present disclosure.

FIGS. 1 and 2 illustrate a paperboard packaging container 10 for bulk solids according to the third aspect of the present disclosure. The particular shape of the container 10 shown in the figures should not be considered limiting to the invention. Accordingly, a packaging container produced according to the invention may have any useful shape or size.

FIG. 1 illustrates the paperboard packaging container 10 in a closed position. The packaging container 10 has a tubular container body 11 with an upper end 12, a bottom end 14 and a container bottom 18. The container body 11 has an inner surface 19 and an outer surface 20.

In FIG. 1 a container body 11 having a cuboid shape is depicted. The paperboard packaging container 10 has a front wall portion, a rear wall portion, side wall portions and curved corner portions connecting the wall portions. The curved corner portions have a radius of curvature of between 15 and 30 mm. The front and rear wall portions may be planar or may have an outwardly curved shape with a radius of curvature of from 200-700 mm. The side wall portions may be substantially planar or may have an outwardly curved shape with a radius of curvature of from 30-700 mm. However, the packaging container the may also for example have a rectangular, triangular or circular shape.

As shown in FIG. 1, the packaging container 10 may be provided with a bottom reinforcement rim 23. The packaging container 10 shown in FIG. 1 further comprises a frame structure 21, which for example may be mechanically connected with an upper reinforcing rim. The frame structure 21 is in FIG. 1 provided with locking elements 22 for retaining a lid 15 in a closed position over the access opening.

The application of elements such as a bottom reinforcing rim 23 to the bottom end 14 of the packaging container 10, an upper reinforcing rim to the upper body opening 13 and a frame structure 21 is optional for the packaging container 10 disclosed herein.

FIG. 2 illustrates the paperboard packaging container 10 with a lid 15 in an open position. The packaging container 10 comprises the sealing disc 1 as a partially removable transport closure, attached to the inner surface 19 of the packaging container 10. Depending on whether the sealing disc 1 is applied from the upper end 12 of the container body 11 or from the bottom end 14 of the container body 11, the sealing disc 1 peripheral outer edge portion 3 which is joined to the inner surface 19 of the container body 11 will be directed downward, toward the bottom body opening or, upward toward the upper body opening 13.

The sealing disc 1 which is shown in FIG. 2 is a paperboard sealing disc 1 comprising a peripheral edge portion 3 surrounding a tear-open part 4. The sealing disc 1 is shown with the first side 6 facing away from the inner compartment of the packaging container. The tear-open part 4 is delimited from the peripheral edge portion 3 by a first cutting line 5' provided on the first side 6. The tear-open part 4 comprises a push-tab 8 and a pull-away part 4'. To facilitate downwards folding of the push-tab 8 for opening of the sealing disc 1, a folding line 9 in the form of a slit is provided between the pull-away part 4' and the push-tab 8. As may be seen in FIG. 2 the peripheral edge portion 3 has a greater width at the push-tab 8 compared to the width at the pull-away part 4'.

Figure 3:
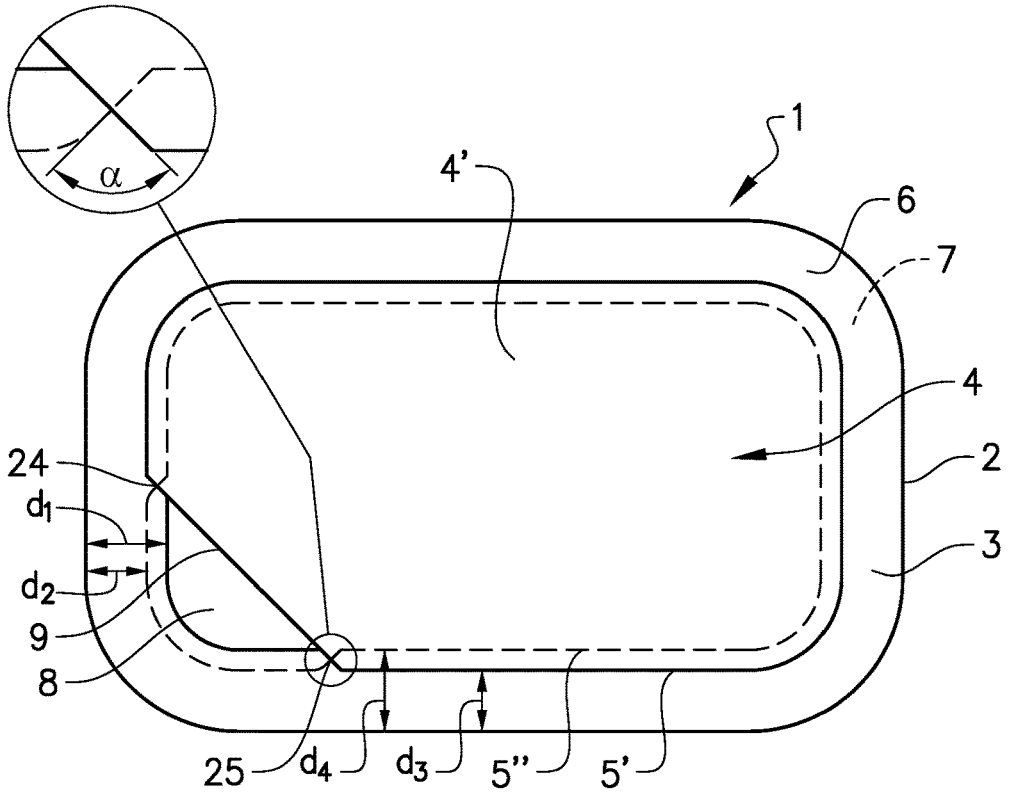
FIG. 3 illustrates a sealing disc according to the present disclosure, as seen from the first side.

FIG. 3 discloses a paperboard sealing disc 1, as seen from the first side 6. The sealing disc 1 is delimited by an outer edge 2 and comprises a peripheral edge portion 3 surrounding a tear-open part 4 which is intended to be removed to provide an opening in the sealing disc 1. The sealing disc 1 is thus a partly removable sealing disc 1, which leaves the peripheral edge portion 3 of the sealing disc 1 attached to the inner wall 19 of the container body 11. The remaining part of the sealing disc 1 may contribute to stabilizing the container opening 13.

The tear open part 4 is, at the first side 6 of the sealing disc 1, delimited from the peripheral edge portion 3 by a first cutting line 5' which has been made into the sealing disc 1 from the first side 6. The cutting line 5' is a continuous cutting line extending into the sealing disc by a cutting depth of from 15 to 80% of the sealing disc 1 thickness. The tear-open part 4 is delimited from the peripheral edge portion 3 at the second side 7 of the sealing disc 1 by a second cutting line 5", shown in this figure as a dotted line. The cutting line 5" is also a continuous cutting line which has been made into the sealing disc 1 from the second side 7 with a cutting depth of from 15 to 80% of the sealing disc 1 thickness. The first cutting line 5' and the second cutting line 5" may either each have a depth of about 50% of the sealing disc thickness or may each have a depth such that the sum of the total depths equals the sealing disc thickness. The first cutting line 5' is, at the push-tab 8, provided at a distance $d_1$ from the sealing disc outer edge 3 and the second cutting line 5", provided at the second side 7, is, at the push-tab 8, provided at a distance $d_2$ from said sealing disc outer edge 2. The first cutting line 5' is, at the pull-away part 4', provided at a distance $d_3$ from the sealing disc outer edge 3 and the second cutting line 5", provided at the second side 7, is, at the pull-away part 4', provided at a distance $d_4$ from said sealing disc outer edge 2. As may be seen in figure, $d_1$ is greater than $d_2$ where the push-tab 8 is delimited from the peripheral edge portion 3 while, where the pull-away part 4' is delimited from the peripheral edge portion 3, $d_4>d_3$.

Figure 4:
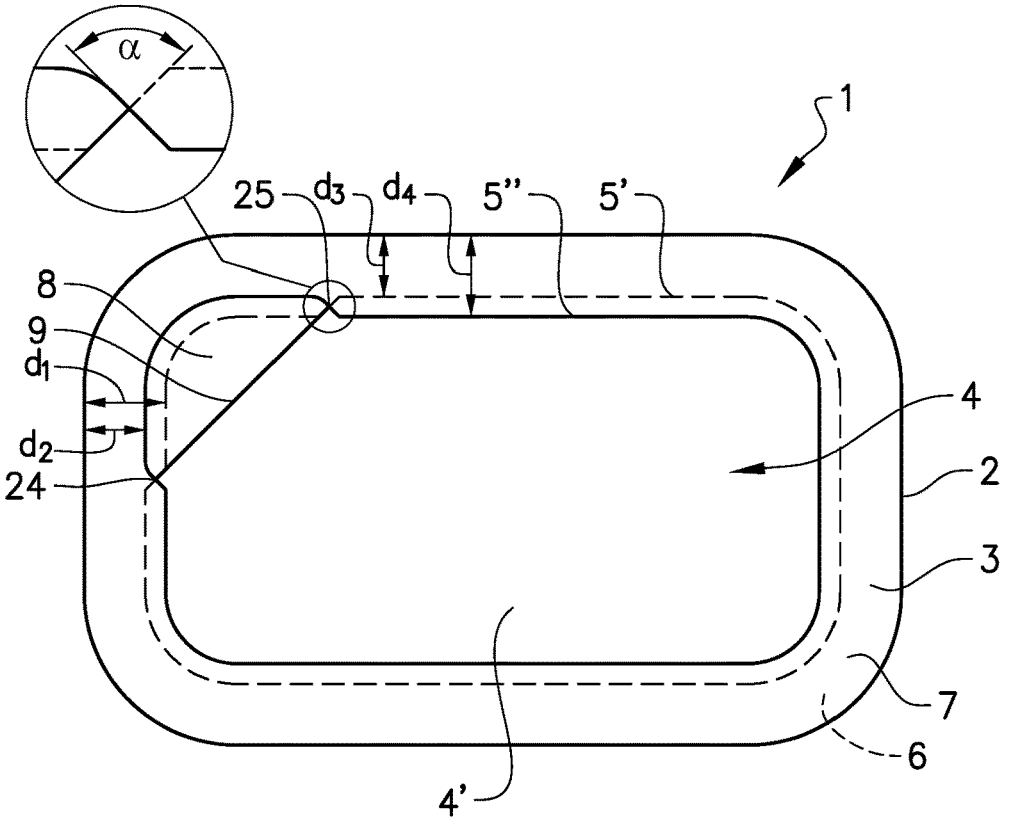
FIG. 4 illustrates a sealing disc according to FIG. 3, as seen from the second side.

FIG. 4 illustrates the sealing disc 1 from the second side 7, with the second cutting line 5" delimiting the tear open part 4 at the second side 7 from the peripheral edge portion 3. The first cutting line 5', provided on the first side 6, is illustrated as a dotted line.

As the distance $d_1$, by with the first cutting line 5' is provided from the outer edge 2, on the first side 6 is greater around the push-tab 8 than the distance $d_2$ on the second side 7, the push-tab 8 is easier to press downwards and there is a reduced risk of breaking the material of the peripheral edge portion 3 as the paperboard material will delaminate at the thickness level of the cutting depth of the cutting line, which may be about 50% of the sealing disc 1 thickness.

As illustrated in FIGS. 3 and 4, the first cutting line 5' is intersecting with the second cutting line 5" at a first and second intersection 24, 25 such that an angle $\alpha$ of between 75° and 115°, such as between 85° and 95°, is formed on the tear-open part by said first and said second cutting lines 5', 5" at each of the first and second intersections 24, 25. After the push-tab part 8 has been folded downwards under the pull-away part 4', notches are formed at the peripheral edge of the tear-open part 4 where the intersections 24, 25 between the first and second cutting lines 5', 5" are located.

Figure 5:
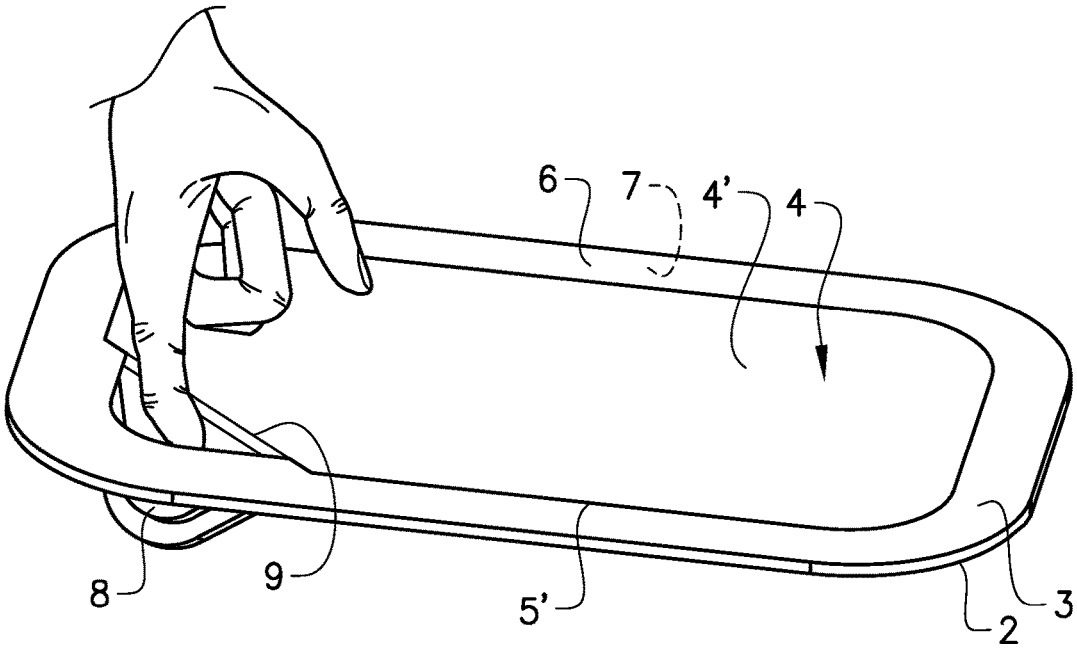
FIG. 5 shows the sealing disc illustrated in FIGS. 3 and 4, with the push-tab being pressed downwards.

FIG. 5 illustrates a sealing disc as disclosed herein, as seen from the first side 6, with the push-tab 8 being pressed downwards. As may be seen in this figure the fact that the first cutting line 5' is provided with a distance $d_1$ which is larger than the distance $d_2$ at the push tab 8, as illustrated in FIGS. 3 and 4, a collar is formed at the push-tab after opening of the push-tab 8. The fact that the first and the second cutting lines 5', 5" are provided with a different distance from the outer edge 2 facilitates opening and minimizes the risk of tearing of the push-tab 8 or the peripheral edge portion 3 as the tearing takes place in the plane where the first and second cutting lines 5', 5" terminate in the interior of the sealing disc thickness and at location where the collar is formed. The fact that the cutting line does not extend throughout the entire sealing disc 1 thickness thus both has the advantage of facilitated opening and improved protection of the bulk solids. The downwards folding of the push-tab part 8 is facilitated when the first side 6 or the first layer 16 of the sealing disc 1 is optionally provided with a folding line 9 in the form of a slit which extends as a straight line from the first intersection 24 between the first and second cutting line 5', 5" to the second intersection 25 between the first and second cutting line (see FIG. 3).

Figure 6:
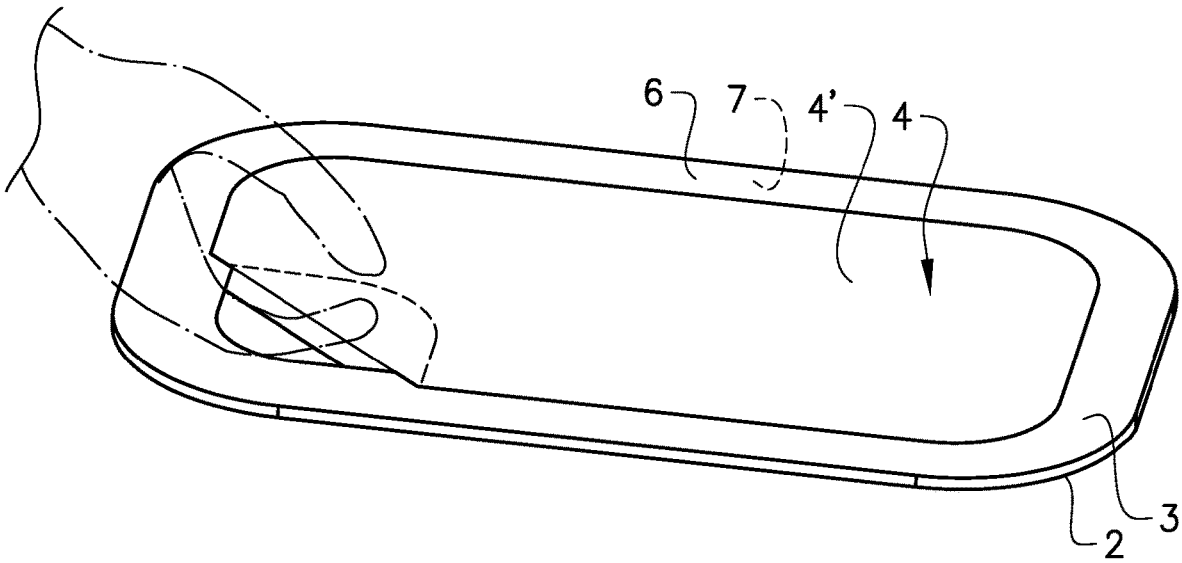
FIG. 6 shows the sealing disc as disclosed herein, with the push-tab being folded in under the pull-away part to provide a gripping portion.

FIG. 6 illustrates the sealing disc 1, as seen from the first side 6, with the push-tab 8 being folded in under the pull-away part 4' to provide a gripping portion which renders the opening of the remaining pull-away part 4' easy and stable and reduces the risk of tearing of the tear-open part 4 during opening of the packaging container 10.

Figure 7:
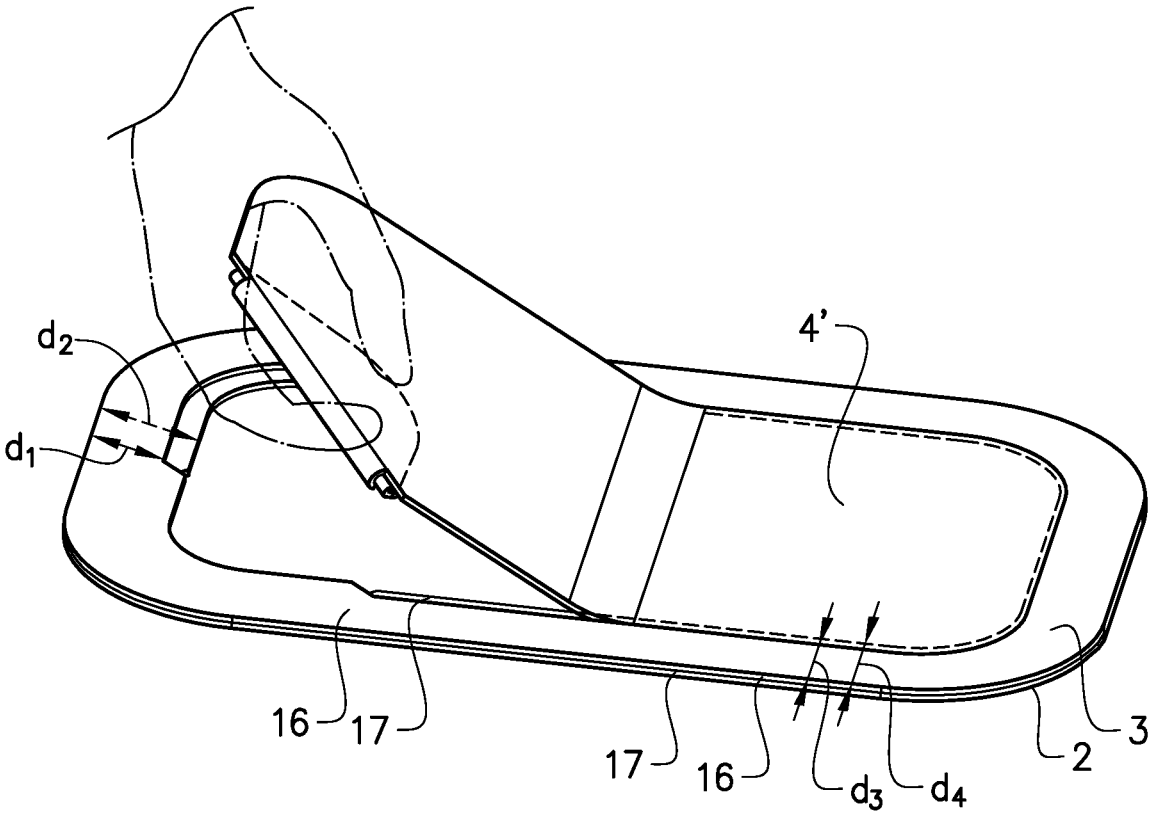
FIG. 7 shows the sealing disc as disclosed herein, with the tear-open part being removed from the sealing disc.

FIG. 7 shows the sealing disc 1 comprising a first layer 16 and a second layer 17, with the tear-open part 4 being partly removed from the sealing disc 1. As may be seen in this figure the fact that the first cutting line 5' is provided with a distance $d_3$ which is smaller than the distance $d_4$ at the pull-away part 4', a collar is formed at the pull-away part 4' by the second layer 17 of the sealing disc 1 after removal of the tear-open part 4.

The invention claimed is:

1. A paperboard sealing disc for use in a packaging container, said sealing disc being delimited by a sealing disc outer edge, said sealing disc comprising a peripheral edge portion surrounding a tear-open part, said sealing disc comprising a first side and a second side, said tear-open part being delimited from said peripheral edge portion by a first cutting line provided on said first side and by a second cutting line provided on said second side, each of said first and said second cutting lines extending only partly through the thickness of said sealing disc, said first cutting line intersecting with said second cutting line at a first and a second intersection, said tear-open part furthermore comprising a push-tab and a pull-away part, said push-tab being at least partly delimited with respect to said pull-away part by a folding line, at said push-tab, said first cutting line is, at said push-tab, provided at a distance d1 from said sealing disc outer edge and said second cutting line is, at said push-tab, provided at a distance d2 from said sealing disc outer edge, said first cutting line is, at said pull-away part, provided at a distance d3 from said sealing disc outer edge and said second cutting line is, at said pull-away part, provided at a distance d4 from said sealing disc outer edge, characterized in that d1>d2 at said push-tab and that d4>d3 at said pull-away part and wherein d1 at said push-tab is substantially the same as d4 at said pull-away part and d2 at said push-tab is substantially the same as d3 at said pull-away part.

2. The sealing disc according to claim 1, characterized in that an angle of between 75° and 115° is formed by said first and said second cutting lines at each of said first and said second intersections.

3. The sealing disc according to claim 1, characterized in that said folding line extends, as a straight line, from said first intersection between said first cutting line and said second cutting line to said second intersection between said first cutting line and said second cutting line.

4. The sealing disc according to claim 1, characterized in that the difference between d1 and d2, and between d3 and d4, are each from 2 mm to 10 mm.

5. The sealing disc according to claim 1, characterized in that said sealing disc and said tear-open part each have a rectangular shape or a rectangular shape with slightly rounded corners.

6. A packaging container for bulk solids, said container comprising a tubular container body with an upper end with an upper body opening and a bottom end with a bottom body opening comprising a container bottom, said container body having an inner surface facing towards an inner compartment in said packaging container and an outer surface facing away from said inner compartment, said packaging container being closed at said upper body opening by a sealing disc characterized in that said sealing disc is a sealing disc according to claim 1.

7. The packaging container according to claim 6, characterized in that said packaging container is a paperboard packaging container.

8. The packaging container according to claim 6, characterized in that sealing disc is a container lid.

9. The packaging container according to claim 6, characterized in that said container comprises a container lid and wherein the sealing disc is a transport closure.

10. The packaging container according to claim 6, characterized in that said sealing disc is attached to said inner surface of said packaging container.

11. A sealing disc for use in a packaging container, said sealing disc being delimited by a sealing disc outer edge, said sealing disc comprising a peripheral edge portion surrounding a tear-open part, said sealing disc comprising a first layer on a first side of said sealing disc and a second layer on a second side of said sealing disc, said tear-open part being delimited from said peripheral edge portion by a first cutting line in said first layer and by a second cutting line in said second layer, said first cutting line intersecting with said second cutting line at a first and a second intersection, said tear-open part furthermore comprising a push-tab and a pull-away part, said push-tab being at least partly delimited with respect to said pull-away part by a folding line, said first cutting line is, at said push-tab, provided at a distance d1 from said sealing disc outer edge and said second cutting line is, at said push-tab, provided at a distance d2 from said sealing disc outer edge, said first cutting line is, pull-away part, provided at a distance d3 from said sealing disc outer edge and said second cutting line is, at said pull-away part, provided at a distance d4 from said sealing disc outer edge, characterized in that d1>d2 at said push-tab and that d4>d3 at said pull-away part and wherein d1 at said push-tab is substantially the same as d4 at said pull-away part and d2 at said push-tab is substantially the same as d3 at said pull-away part.

12. The sealing disc according to claim 11, characterized in that said first layer of said sealing disc is laminated to said second layer of said sealing disc.

13. The sealing disc according to claim 11, characterized in that said folding line is provided on said first side or first layer of said sealing disc.

14. The sealing disc according to claim 11, characterized in that said folding line is a slit provided on said first side or first layer of said sealing disc.

15. The sealing disc according to claim 14, characterized in that said slit being formed by a portion of said first cutting line extending between said first and second intersections between said first cutting line and said second cutting line.

16. The sealing disc according to claim 15, characterized in that said push-tab is provided in a corner portion of said tear-open part.

* * * * *